US007320509B2

(12) United States Patent
Kobayashi et al.

(10) Patent No.: US 7,320,509 B2
(45) Date of Patent: Jan. 22, 2008

(54) INKJET APPARATUS

(75) Inventors: Shinya Kobayashi, Hitachinaka (JP); Takahiro Yamada, Hitachinaka (JP); Hitoshi Kida, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 358 days.

(21) Appl. No.: 11/079,774

(22) Filed: Mar. 15, 2005

(65) Prior Publication Data

US 2005/0200639 A1 Sep. 15, 2005

(30) Foreign Application Priority Data

Mar. 15, 2004 (JP) ..... P2004-073323

(51) Int. Cl.
*B41J 29/38* (2006.01)

(52) U.S. Cl. ..... 347/10; 347/6; 347/9

(58) Field of Classification Search ..... 347/10
See application file for complete search history.

(56) References Cited

U.S. PATENT DOCUMENTS

2003/0103095 A1* 6/2003 Imai ..... 347/5
2003/0142160 A1* 7/2003 Kobayashi et al. ..... 347/14

FOREIGN PATENT DOCUMENTS

JP 04-316851 11/1992
JP 09-011547 1/1997
JP 2002-273890 9/2002

* cited by examiner

*Primary Examiner*—Matthew Luu
*Assistant Examiner*—Jannelle M. Lebron
(74) *Attorney, Agent, or Firm*—Whitham Curtis Christofferson & Cook, P.C.

(57) ABSTRACT

An inkjet apparatus 100 includes a plurality of nozzles 200, a plurality of piezoelectric elements 204, a drive voltage generator 406 and a plurality of switches 403. The plurality of piezoelectric elements 204 is provided in one-to-one correspondence with the plurality of nozzles 200. The drive voltage generator 406 generates a drive voltage having a waveform Vd. Each switch 403 adjusts the waveform Vd of the drive voltage. Each of the plurality of piezoelectric elements 204 applies pressure to a corresponding nozzle 200 to eject ink droplets therefrom in response to the drive voltage having an adjusted waveform Vd.

11 Claims, 8 Drawing Sheets

FIG.6

| | | WAVEFORM a | WAVEFORM b | WAVEFORM c | WAVEFORM d |
|---|---|---|---|---|---|
| WAVEFORM ADJUSTMENT DATA | | CRDa | CRDb | CRDc | CRDd |
| EJECTION SIGNAL | NOZZLE 1 | D1a | D1b | D1c | D1d |
| | NOZZLE 2 | D2a | D2b | D2c | D2d |
| | NOZZLE 3 | D3a | D3b | D3c | D3d |
| | NOZZLE 4 | D4a | D4b | D4c | D4d |
| | ------- | ------- | ------- | ------- | ------- |
| | NOZZLE N | DNa | DNb | DNc | DNd |

FIG.7

| | | WAVEFORM a | WAVEFORM b | WAVEFORM c | WAVEFORM d |
|---|---|---|---|---|---|
| WEIGHT | NOZZLE 1 | M1a | M1b | M1c | M1d |
| | NOZZLE 2 | M2a | M2b | M2c | M2d |
| | NOZZLE 3 | M3a | M3b | M3c | M3d |
| | NOZZLE 4 | M4a | M4b | M4c | M4d |
| AVERAGE WEIGHT M | | $M = \left( \sum_{j=a}^{d} \sum_{i=1}^{4} Dij \times Mij \right) / 16$ | | | |

INKJET APPARATUS

BACKGROUND OF THE INVENTION

1. Field of the Invention

The present invention relates to a high-speed, multi-nozzle inkjet apparatus.

2. Description of Related Art

A multi-nozzle inkjet apparatus including a large number of nozzles can print on a medium such as a substrate at a high-speed and at a high density. A multi-nozzle inkjet apparatus including an inkiest head for an on-demand method is disclosed in Japanese Patent Application No.2002-273890. This apparatus has a large number of nozzles and ejects ink particles from the opening of each nozzle by applying pressure to an ink chamber by driving a piezoelectric element or the like. Since an inkjet head for the on-demand method has a simpler structure, several hundred or several thousand nozzles can be disposed at a high density.

Recently, the multi-nozzle inkjet apparatus is used to form thin films. In order to form a thin film by using a multi-nozzle inkjet device, tiny ink droplets on the order of 10 to 20 mg must be ejected uniformly, and variations in the weight of the ink droplets that are ejected from each nozzle must be kept to within a few percent. However, Japanese Patent Application No. 2002-273890 has large variations in the weight of ink droplets ejected from the nozzles, since the nozzles have different nozzle characteristics. In view of commercial profitability, it is difficult to increase the precision of nozzle fabrication and restrain weight variations to within a few percent.

Adjustment of ejection weight is used to suppress weight variations. The adjustment of ejection weight adjusts the ink ejection quantity by finely adjusting each drive voltage waveform that is applied to the piezoelectric element of each nozzle, and thus corrects the ejection weights. Japanese Patent-Application No. 9-11457 discloses an inkjet apparatus performing an adjustment of ejection weight, where the inkjet apparatus is provided with a plurality of drive waveform generators that generate the different drive voltage waveforms respectively, and applies a desired drive voltage waveform to each nozzle.

Japanese Patent-application No. 4-316851 discloses an inkjet apparatus that is provided with a single drive waveform generator that can generate a plurality of drive voltage waveforms, for all the nozzles in common. Since the inkjet apparatus cannot apply different drive voltage waveforms for the nozzles simultaneously, the desired drive voltage waveform is applied to one nozzle at a time sequentially by a time-division method.

Japanese Patent Application No.9-11457 encounters no problem when the number of nozzles is small. However, when there are several hundred or several thousand nozzles, it is difficult to produce the inkjet apparatus since the number of drive waveform generators increases and the circuit for selecting these drive waveform generators becomes more complicated.

Japanese Patent Application No. 4-316851 also encounters no problem when the number of nozzles is small. However, when there are several hundred or several thousand nozzles, the number of time divisions grows too large and thus the number of ejections also increases correspondingly, so the coating speed deteriorates dramatically.

SUMMARY OF THE INVENTION

In view of the foregoing, it is an object of the present invention to provide a multi-nozzle inkjet apparatus that can paint ink uniformly, without any increase in the drive waveform generation circuitry and without reducing the coating speed.

In order to attain the above and other objects, the present invention provides an inkjet apparatus including a plurality of nozzles, a plurality of piezoelectric elements, a drive voltage generator and an adjustment unit. The plurality of nozzles ejects ink droplets. The plurality of piezoelectric elements is provided in one-to-one correspondence with the plurality of nozzles. The drive voltage generator generates a drive voltage having a waveform. The adjustment unit adjusts the waveform of the drive voltage. Each of the plurality of piezoelectric elements applies pressure to a corresponding nozzle to eject ink droplets therefrom in response to the drive voltage having an adjusted waveform.

It is preferable that the plurality of piezoelectric elements is actuated substantially simultaneously.

It is preferable that the drive voltage generator generates a number of drive voltages having different waveforms and the number of drive voltages generated by the drive voltage generator is less than a number of nozzles.

It is preferable that the inkjet apparatus further includes a data processor. The data processor transfers both a waveform adjustment data and an ejection signal to the adjustment unit. The waveform adjustment data determines a waveform to be applied to the piezoelectric element. The ejection signal indicates whether or not the nozzle ejects an ink droplet. The adjustment unit adjusts the waveform of the drive voltage based on the waveform adjustment data and controls the ejection of ink droplet in response to the ejection signal.

It is preferable that the drive voltage generator generates a single drive voltage having a predetermined waveform.

It is preferable that each of the plurality of piezoelectric elements has an individual electrode and a common electrode common to the plurality of piezoelectric elements, and expands and contracts when a potential difference exists between the individual electrode and the common electrode. The adjustment unit includes a switch having first and second terminals. The first terminal is connected to the individual electrode and the second terminal to ground. The waveform of the drive voltage is adjusted while opening and closing the switch.

It is preferable that both the waveform adjustment data and the ejection signal are digital signals.

It is preferable that the drive voltage applied to each of the plurality of piezoelectric elements is controlled based on the waveform adjustment data and the ejection signal so that a total weight of ink droplets ejected from a prescribed number of nozzles during a period of time when a predetermined number of ejection signals are generated is substantially constant and all the ink droplets blend with each other to attain a leveling effect.

It is preferable that the plurality of nozzles is aligned at an equi-pitch, and the prescribed number of nozzles is aligned one after another.

It is preferable that the inkjet apparatus further includes a memory. The memory stores combined data that is a combination of the waveform adjustment data and the ejection signal both transferred from the data processor. The memory transfers the combined data stored in the memory to the adjustment unit repeatedly.

It is preferable that the inkjet apparatus further includes a selector. The selector selectively transfers one of the combined data stored in the memory and the combined data transferred directly from the data processor to the adjustment unit based on a select signal input to the selector from the data processor.

It is preferable that the inkjet apparatus further includes a memory and a gate. The memory stores combined data that is a combination of the waveform adjustment data and the ejection signal both transferred from the data processor, and transfers the combined data stored in the memory to the adjustment unit repeatedly. The gate is connected to the adjustment unit, and prohibits the combined data stored in the memory from passing to the adjustment unit based on an instruction from the data processor.

It is preferable that the inkjet apparatus further includes a selector. The selector selectively transfers one of the combined data stored in the memory and the combined data transferred directly from the data processor to the memory based on a select signal input to the selector from the data processor.

It is preferable that the inkjet apparatus further includes a gate. The gate controls the switch to open when the combined data is being transferred to the memory.

BRIEF DESCRIPTION OF THE DRAWINGS

The above and other objects, features and advantages of the invention will become more apparent from reading the following description of the preferred embodiments taken in connection with the accompanying drawings in which:

FIG. 6 is an explanatory diagram showing the configuration of the digital coating signal DAT;

FIG. 7 is an explanatory diagram showing the weights of droplets ejected the first four nozzles 1 to 4;

DETAILED DESCRIPTION OF THE PREFERRED EMBODIMENTS

Figure 1:
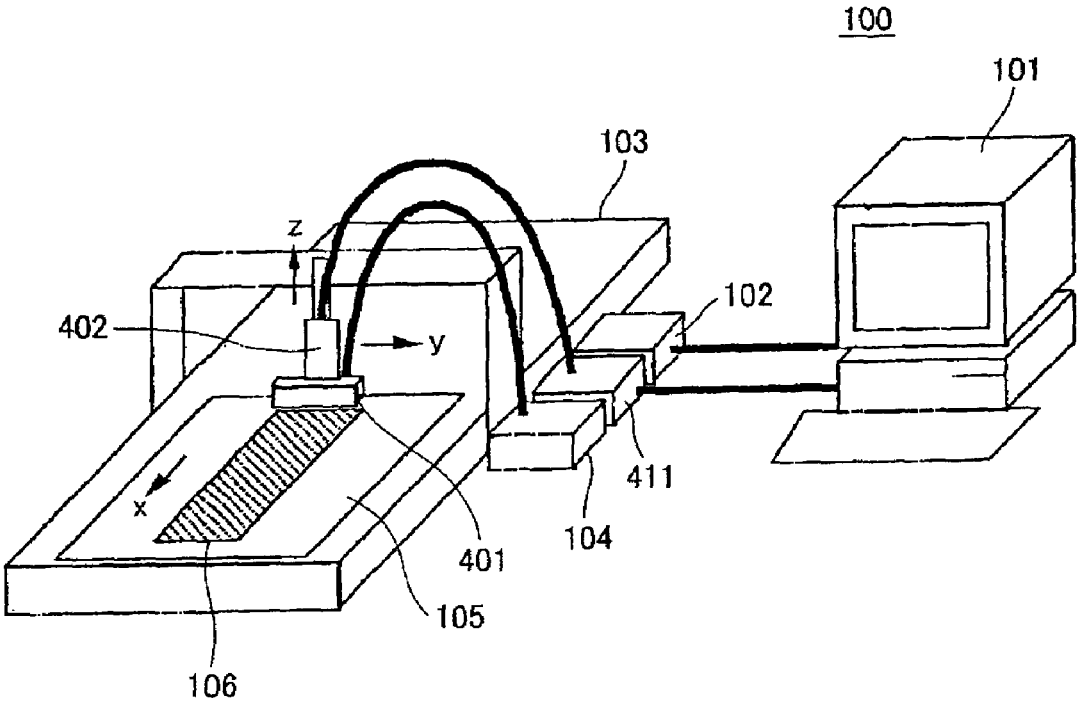
FIG. 1 is a perspective view showing the inkjet apparatus 100.

An inkjet apparatus 100 according to first embodiment of the present invention will be described while referring to the accompanying drawings. FIG. 1 is a perspective view showing the inkjet apparatus 100. The inkjet apparatus 100 is provided with a controller 101, an XYZ stage controller 102, an XYZ stage 103, an ink tank 104, a nozzle module 401, a piezoelectric element driver 402, and an digital signal processor 411. A substrate 105 is mounted on the XYZ stage 103. A film 106 is formed on the substrate 105. Other components, such as a TV camera for positioning, a heater and dryer for leveling control described later, and a protective device for the nozzle module (not shown), are mounted on the XYZ stage 103.

The controller 101 controls the XYZ stage controller 102 and the digital signal processor 411. The XYZ stage controller 102 controls the movement of the XYZ stage 103 mounting the substrate 105 in the X direction (main scan direction), and also controls the movement of the nozzle module 401 in the Y direction (sub scan direction) and Z direction (height direction). The digital signal processor 411 controls the piezoelectric element driver 402 causing the nozzle module 401 to eject ink. The ink tank 104 supplies ink to the nozzle module 401.

Next, the operation of the inkjet apparatus 100 will be described. When the substrate 105 is mounted on the XYZ stage 103, the XYZ stage controller 102 controls the substrate 105 and the nozzle module 401 to move to a coating start position. Ink droplets are ejected onto the substrate 105 from the nozzle module 401 while the substrate 105 is moved in the X direction. The nozzle module 401 is then moved a prescribed distance in the Y direction to scan another line. Ink droplets are again ejected from the nozzle module 401 onto the substrate 105 while the substrate 105 is moved in the X direction. By repeating the above operations, a film 106 is formed over the entire substrate 105.

Figure 2:
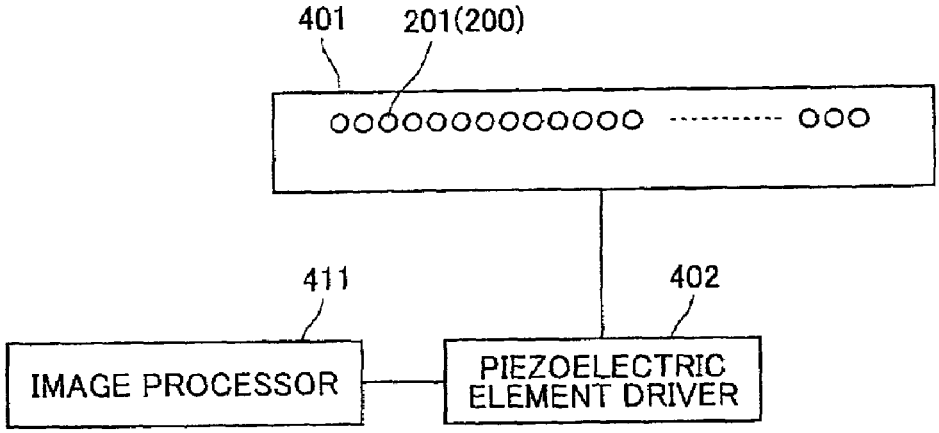
FIG. 2 is an explanatory diagram showing the configuration of the nozzle module 401 of embodiments of the present invention.

FIG. 2 is an explanatory diagram showing the connections between the nozzle module 401, the piezoelectric element driver 402, and the digital signal processor 411. The nozzle module 401 has N nozzles 200 that are arranged linearly across the nozzle module 401. The nozzle density is 150 npi (nozzles/inch). In this embodiment, 128 of the nozzles 200 are disposed in the nozzle module 401. If a larger number of nozzles are necessary, a plurality of nozzle modules 401 may be provided.

Figure 3:
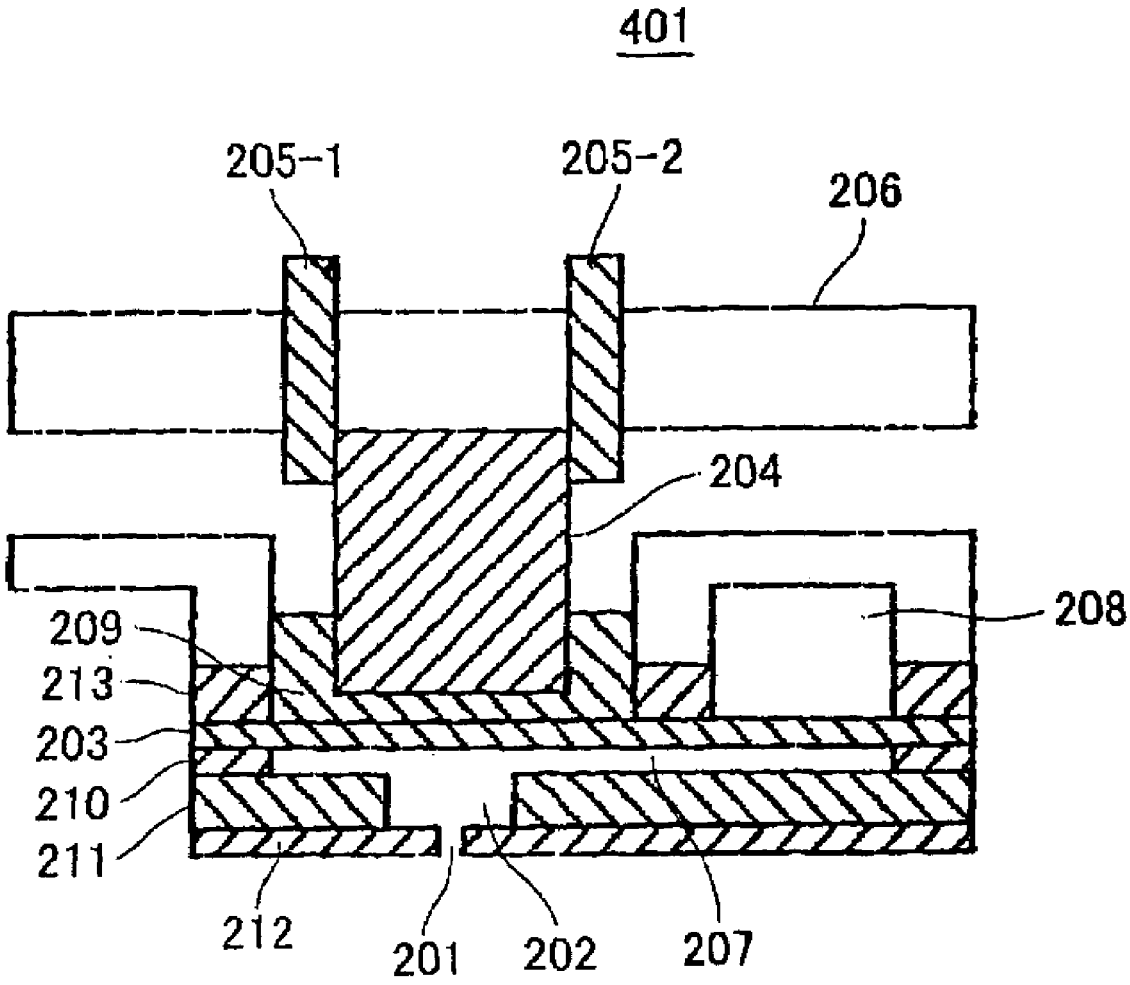
FIG. 3 is a cross-sectional view showing the construction of the nozzle 200.

Next, the nozzle 200 will be described with reference to FIG. 3. FIG. 3 is a cross-sectional view showing the construction of the nozzle 200 in the preferred embodiment. The nozzle 200 includes an orifice plate 212, a pressure chamber plate 211, and a restrictor plate 210. The orifice plate 212 forms a nozzle hole 201 (orifice). The pressure chamber plate 211 forms a pressure chamber 202. The restrictor plate 210 forms a restrictor 207. A common ink supply channel 208 is also formed in the nozzle 200 for supplying ink to the pressure chamber 202. The restrictor 207 is in communication with the common ink supply channel 208 and pressure chamber 202 and controls the amount of ink flow to the pressure chamber 202.

The nozzle 200 also includes a vibration plate 203, a piezoelectric element 204, a support plate 213, and a piezoelectric element fixing plate 206. The vibration plate 203 and piezoelectric element 204 are coupled by an elastic material 209, such as a silicon adhesive. The piezoelectric element 204 is provided with a common electrode 205-1 and an individual electrode 205-2. When a potential difference is generated between the common electrode 205-1 and individual electrode 205-2, the piezoelectric element 204 expands or contracts. The support plate 213 functions to reinforce the vibration plate 203. The piezoelectric element fixing plate 206 fixes the piezoelectric element 204 in place.

The vibration plate 203, restrictor plate 210, pressure chamber plate 211, and support plate 213 are formed of stainless steel. The orifice plate 212 is formed of a nickel material, The piezoelectric element fixing plate 206 is formed of an insulating material such as a ceramic or polyimide.

With this construction, ink supplied from an ink tank (not shown) is distributed to each restrictor 207 via the common ink supply channel 208 and supplied to the pressure chambers 202 and the nozzle holes 201. When a potential difference is generated between the common electrode 205-1 and individual electrode 205-2, the piezoelectric element. 204 deforms to eject a portion of the ink in the pressure chamber 202 through the nozzle hole 201.

Figure 4:
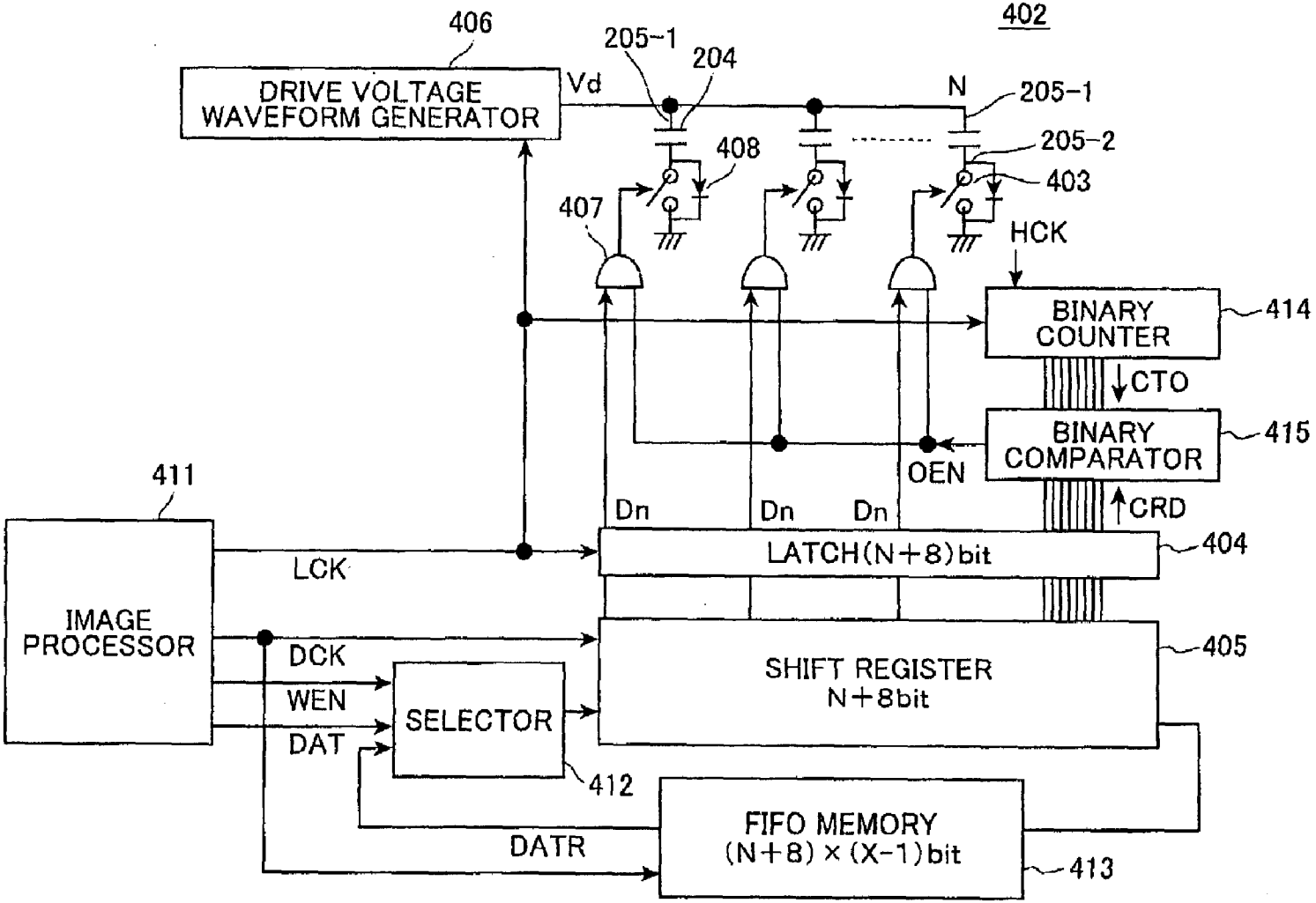
FIG. 4 is a circuit diagram of the digital signal processor 411 and the piezoelectric element driver 402.

Next, the digital signal processor 411 and the piezoelectric element driver 402 will be described with reference to FIG. 4. FIG. 4 is a circuit diagram of the digital signal processor 411 and the piezoelectric element driver 402. In FIG. 4, the piezoelectric element 204 is denoted by a capacitor symbol. The piezoelectric element driver 402 is provided with N switches 403, a latch 404, a shift register 405, a drive voltage waveform generator 406, N AND gates 407, a selector 412, a FIFO memory 413, a binary counter 414, and a binary comparator 415.

The digital signal processor 411 outputs a latch clock LCK to the latch 404, the drive voltage waveform generator 406, and the binary counter 414; outputs a data clock DCK to the shift register 405 and the FIFO memory 413; and outputs a select signal WEN and a digital coating signal DAT to the selector 412.

The data clock DCK is a signal that keeps time used as a reference for all operations of the inkjet apparatus 100. The digital coating signal DAT is (N+8)-bit serial data, where the first 8 bits are waveform adjustment data CRD and the other N bits are ejection signals Dn. The waveform adjustment data CRD takes any value from 0 to 255 and is data for adjusting the voltage applied to the individual electrode 205-2 over 256 steps, by pulse width modulation. The ejection signal Dn controls the ejection of droplets from each nozzle 200, where an ink droplet is ejected when the logic of the ejection signal Dn is "1", while an ink droplet is not ejected when the logic of the ejection signal Dn is "0".

The latch clock LCK is a latch signal for the latch 404 to latch data input to the shift register 405, a synchronization signal for the drive voltage waveform generator 406, and a start signal for the binary counter 414 to start count. The select signal WEN is a signal for the selector 412 to select which of the digital coating signal DAT or a cyclic data DATR that will be described later.

The selector 412 outputs the signals selected by the select signal WEN sequentially to the shift register 405, in synchronization with the data clock DCK. Specifically, the selector 412 outputs the digital coating signal DAT when the logic of the select signal WEN is "1", while the selector 412 outputs the cyclic data DATR when the logic thereof is "0". The shift register 405 is an (N+8) bit rotary shift register that stores the data (either the digital coating signal DAT or the cyclic data DATR that will be described later) input from the selector 412. The FIFO memory 413 has a capacity of (N+8)×(X−1). The FIFO memory 413 stores the data that has been input from the shift register 405, and outputs the data to the selector 412 as the cyclic data DATR.

The latch 404 latches the data stored in the shift register 405 in synchronization with the latch clock LCK. The latch 404 outputs the waveform adjustment data CRD, that is the first 8 bits of the digital coating signal DAT or the cyclic data DATR, to the binary comparator 415 in synchronization with the latch clock LCK. Further, the latch 404 outputs the ejection signals Dn, that is the last N bits of the digital coating signal DAT or the cyclic data DATR, to the AND gates 407.

The binary counter 414 counts a high-frequency clock HCK input from an exterior instrument (not shown) and outputs a count signal CTO to the binary comparator 415. The count signal CTO is decremented one digit at a time, from 255, to 254, 253, 252, etc., and the binary counter 414 automatically stops when the count signal CTO reaches 0. The high-frequency clock HCK is a 32 MHz clock and the count signal CTO becomes 0 at 8 μs.

The binary comparator 415 compares the waveform adjustment data CRD from the latch 404 with the count signal CTO from the binary counter 414, and outputs a comparison signal OEN to the AND gates 407. More specifically, if the count signal CTO is greater than the waveform adjustment data CRD, the binary comparator 415 outputs "1" as the comparison signal OEN to the AND gates 407, whereas if the count signal CTO is less than or equal to the waveform adjustment data CRD, the binary comparator 415 outputs "0" as the comparison signal OEN to the AND gates 407.

Each of the AND gates 407 performs AND operation on the comparison signal OEN and the ejection signal Dn input. from latch 404, and outputs the result to the switch 403 The switch 403 is connected to the individual electrode 205-2. The individual electrode 205-2 is grounded electrically through the switch 403. A diode 408 is also connected in parallel with the switch 403, with the anode connected to the individual electrode 205-2 side and the cathode connected to the ground side. The corresponding switch 403 closes if the logics of both the comparison signal OEN and the ejection signal Dn are "1", but the switch 403 opens in all other cases. The drive voltage waveform generator 406 outputs a single drive voltage waveform Vd to the common electrode 205-1 in synchronization with the latch clock LCK.

Figure 5:
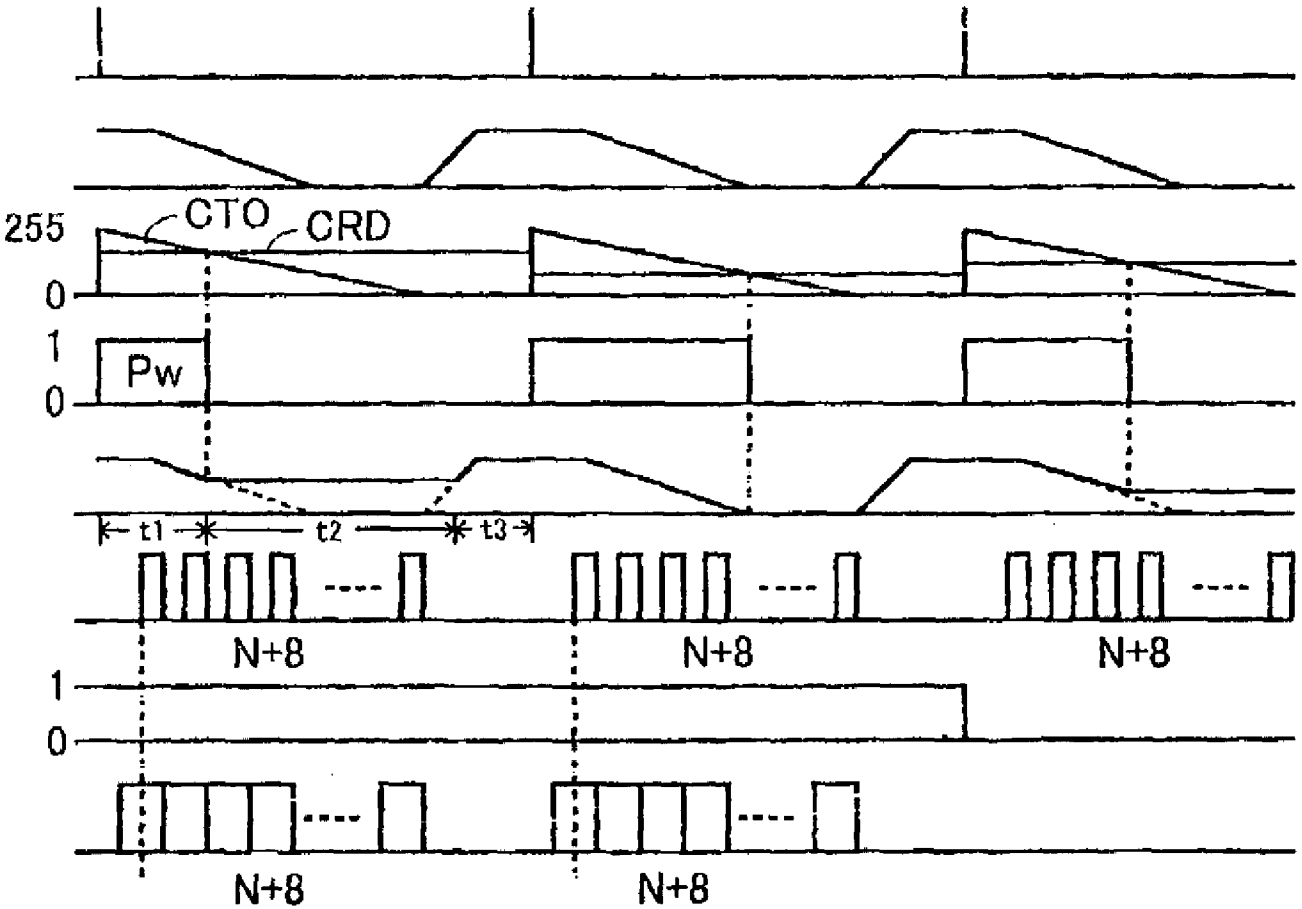
FIGS. 5(*a*)-5(*h*) are timing charts of the waveform adjustment operation.

Next, a waveform adjustment operation will be described with reference to FIGS. 5(*a*)-5(*h*). FIGS. 5(*a*)-5(*h*) are timing charts of the waveform adjustment operation. All of the operations are performed at timings that are integral multiples of the count of the data clock DCK.

First of all, the data clock DCK is input from the digital signal processor 411 to the shift register 405, though not shown. Simultaneously, the digital coating signal DAT and the select signal WEN are input from the digital signal processor 411 to the selector 412.

At the start of the operation, the select signal WEN (see FIG. 5(*g*)) is "1" in order to select the digital coating signal DAT, since the cyclic data DATR has not been stored in the FIFO memory 413. The selector 412 transfers the digital coating signal DAT sequentially to the shift register 405 in synchronization with the data clock DCK until the digital coating signal DAT (N+8 bits) for one ejection cycle has been transferred to the shift register 405. The shift register 405 stores the digital coating signal DAT sequentially. Then, the shift register 405 outputs the digital coating signal DAT to the FIFO memory 413. The FIFO memory 413 sequentially stores the digital coating signal DAT.

When all of the digital coating signal DAT (N+8 bits) for one ejection cycle has been transferred to the shift register 405, the latch clock LCK is issued (see FIG. 5(*a*)). The digital coating signal DAT (the waveform adjustment data CRD plus the ejection signals Dn) stored in the shift register 405 are latched by the latch 404 in synchronization with the latch clock LCK. Note that it could be set to occur periodically by a timer or the like, or it could be issued on the basis of a signal from a sensor (such as an encoder) that detects the coating location.

The drive voltage waveform generator 406 generates the drive voltage waveform Vd (see FIG. 5(*b*)) in synchronization with the latch clock LCK. The drive voltage waveform Vd is a waveform in the shape of a trapezoid, as shown in FIG. 5(*b*). The binary counter 414 starts the count of the high-frequency clock HCK in synchronization with the latch clock LCK, and outputs the count signal CTO (see FIG. 5(*c*)) to the binary comparator 415.

The waveform adjustment data CRD (see FIG. 5(*c*)) that is latched by the latch 404 is output to the binary comparator 415. The binary comparator 415 compares the count signal CTO with the waveform adjustment data CRD, and outputs the comparison signal OEN (see FIG. 5(*d*)) that is a pulse which is pulse width modulated. The logic of the comparison signal OEN whose pulse width Pw is 0<Pw<8 μs is either "1" or "0". Each of the AND gates 407 performs the AND operation on the comparison signal OEN and the ejection signal Dn (see FIG. 5(*h*)) input from latch 404, and outputs the result to the switch 403. The corresponding switch 403 closes if the logics of both the comparison signal OEN and the ejection signal Dn are "1", but the switch 403 opens in all other cases.

When the switch 403 closes, the individual electrode 205-2 is grounded and the potential difference equivalent to the drive voltage Vd is generated between the common electrode 205-1 and individual electrode 205-2 (FIG. 5(*e*) (t1)). A current flows through the switch 403 and the piezoelectric element 204 expands corresponding to the potential difference between the max voltage of the trapezoid and the voltage of the end of the t1.

However, when the switch 403 opens, the individual electrode 205-2 is released and the charge accumulated in the piezoelectric element 204 is held without change. So there is no change in the potential difference between the common electrode 205-1 and the individual electrode 205-2. The voltage applied to the common electrode 205-1 drops as the drive voltage Vd drops, but potential of the individual electrode 205-2 also drops by just the same potential from the ground potential, to maintain the potential difference between the common electrode 205-1 and the individual electrode 205-2. In this case, since the anode side of the diode 408 is at negative potential, the action of the diode 408 prevents the flow of current (see FIG. 5(*e*) (t2)). Thus, the piezoelectric element 204 maintains the expanding state.

Finally, as the drive voltage Vd rises, the potential of the individual electrode 205-2 also rises. When the potential becomes greater than the ground potential, a current starts to flow through the diode 408. The drive voltage Vd is applied without change to the voltage element 204 (see FIG. 5(*e*) (t3)). Thus, the piezoelectric element 204 contracts and one ejection cycle completes.

The drive voltage waveform Vd applied to each piezoelectric element 204 is adjusted by the corresponding opening and closing of switches 403. This becomes the same as modulating the drive voltage waveform Vd from the drive voltage waveform generator 406. In this manner, the amount of ink ejected from the nozzle 200 can be adjusted.

Continuously, the ejection is performed (X-1) cycles in order to store the X digital coating signal DAT in the shift register 405 and the FIFO memory 413. The cyclic data DATR stored within the FIFO memory 413 can be used repeatedly thereafter by switching the select signal WEN to "0". If it is necessary to modify X cycles of the digital coating signal DAT that have already been stored, the select signal WEN could be switched again to "1" in order to transfer the new digital coating signal DAT to the shift register 405.

Thus, the drive voltage waveform Vd applied to the voltage element 204 can be adjusted at each ejection cycle by the waveform adjustment data CRD that is handled in similar way as the ejection signals Dn, while the drive voltage waveform generator 406 generates only one waveform. These enable a simplification of the inkjet apparatus 100, since there is no need to provide a circuit for outputting the digital waveform adjustment data CRD and a circuit for outputting the digital ejection signal Dn separately to the drive voltage waveform generator 406.

The timing of switching the select signal WEN is arbitrary. Accordingly, it is possible to transfer a new digital coating signal by switching the select signal WEN to "1" anytime. When the same data is transferred to the shift register 405 repeatedly in such a case to form ordinary simple film formation, it is convenient to select the cyclic data DATR, saving the transfer time, capacity and the like.

In this embodiment, a leveling process is performed in order to smooth the film 106 in film-formation process. The leveling process is a technique that combines an ink droplet with another ink droplet by ejecting the ink droplets sequentially before the tackiness phenomenon due to drying starts up. Accordingly, each nozzle 200 is controlled so that a total weight of ink droplets in a predetermined area is in coincidence with a predetermined weight. Several types of the drive voltage waveforms are used so that the total weight of the ink droplets in the predetermined area is in coincidence with the predetermined weight accurately. Accordingly, four drive voltage waveforms a to d are used in this embodiment.

FIG. 6 is an explanatory diagram showing the configuration of the digital coating signal DAT. Each drive voltage waveforms a to d corresponds to the waveform adjustment data CRDa to CRDd respectively. The voltage widths of the waveforms a to d are assumed 100% (no adjustment, that is, the voltage between the upper base and the lower base of the trapezoid), 90%, 80%, and 70% of the voltage width of the trapezoid-shaped voltage waveform Vd. In the first ejection cycle, the waveform adjustment data CRDa (8 bits) and the ejection signals D1*a*, D2*a*, . . . , DNa (1 bit each) for each of the nozzles 200 are transferred.

In the next ejection cycle, the waveform adjustment data CRDb (8 bits) and the ejection signals D1*b*, D2*b*, . . . , DNb (1 bit each) for each of the nozzles 200 are transferred In this manner, the digital coating signal DAT with respect to the waveform c and d are transferred, and the transfer ends. The digital coating signal DAT that has already been transferred is subsequently used repeatedly, as described previously.

Next, the method of generating the digital coating signal DAT for X cycles will be described with reference to FIGS. 7 to 9. As described previously, since (N+8) bits of the digital coating signal DAT is transferred by one ejection cycle, the amount of data for X cycles is: (N+8)×X bits. The description below will be described with the specific case where X =4 (waveforms a to d described below). Firstly, the droplet ejected by each of the nozzles 200 is weighed in order to determine the accurate weight of droplets ejected by each nozzle 200. Specifically, 500,000 droplets are collected from each nozzle 200, while applying the waveform a at 10 kHz to the nozzle 200. Then, the total weight of the 500,000 droplets is measured using electronic scales, and divides the total weight by 500,000. This is also done with waveforms b to d. This provides weight Mn of an ink droplet ejected by each nozzle 200 for each waveform (waveforms a to d).

Next, the digital coating signal DAT for each group of several nozzles, four nozzles 1 to 4 in this embodiment, is divided. This group of four nozzles 1 to 4 is called a block having 4×4 dots. FIG. 7 is an explanatory diagram showing the weights of droplets ejected the first four nozzles 1 to 4. Each nozzle 1 to 4 can eject an ink droplet corresponding to the waveforms a to d, and also either eject or not eject an ink droplet. Accordingly, the combination of a total weight m is 65,536 ($=2^{16}$) ways. The total weight m of each combination is calculated using the weight. Mn for each waveform (waveforms a to d) that was obtained as described above, and all the total weight m are arranged in order of the weight. The closest total weight m to a desired weight is chosen from among the total weights m that are arranged in order of the weight. In this embodiment, an average weight M of all the total weights m is chosen. The average weight M for 65,536 combinations can be obtained from the equation:

$$M = \left(\sum_{j=a}^{d}\sum_{i=1}^{4} Dij \times Mij\right) \Big/ 16$$

The total weights m of all the blocks can be matched with the average weight M with an extremely high precision by performing this procedure for all the blocks.

Figure 8:
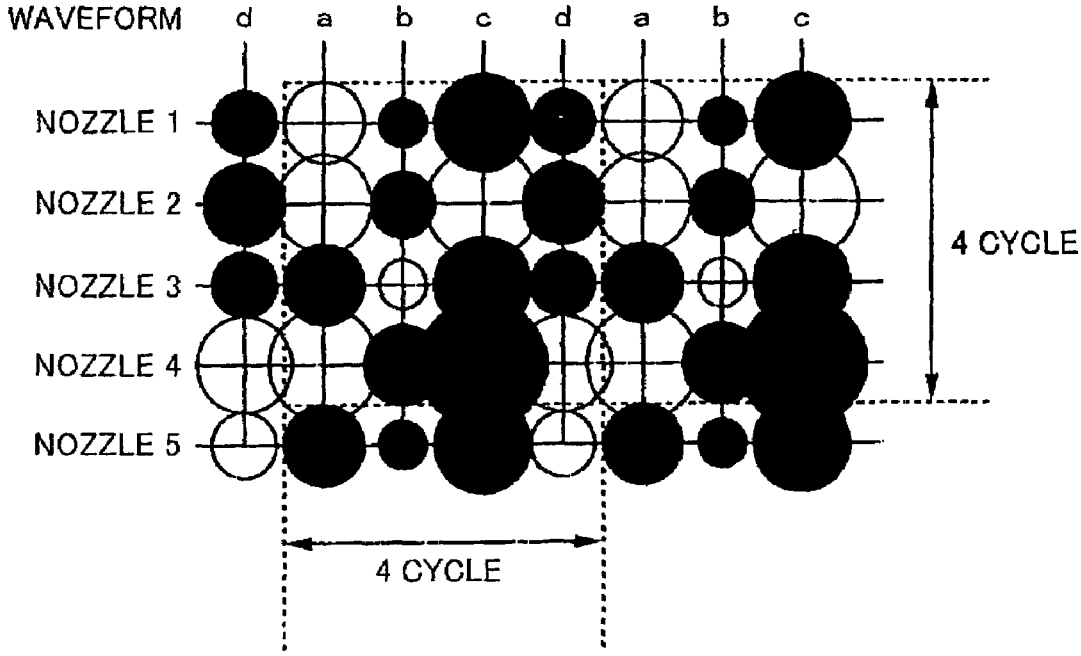
FIG. 8 is an explanatory diagram showing a state that the ink droplets are ejected on the substrate 105.
Figure 9A:
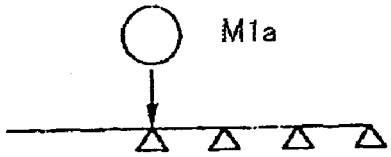
FIGS. 9(*a*)-9(*e*) are explanatory diagrams showing the leveling process.
Figure 9B:
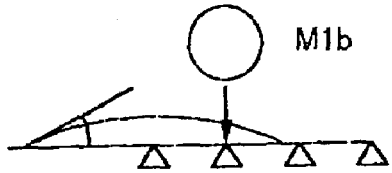
Figure 9C:
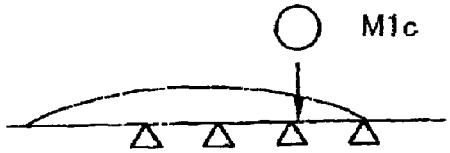
Figure 9D:
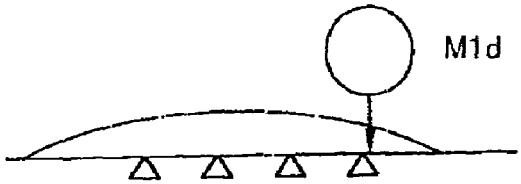
Figure 9E:
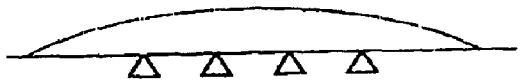

FIG. 8 is an explanatory diagram showing a state that the ink droplets are ejected on the substrate 105. The size of each circle represents the ejection weight after a droplet has been ejected, where the black circles represent droplets that were actually ejected and the white circles represent droplets that were not actually ejected. It can be seen that the image is not formed uniformly. However, the image is smoothed by the leveling process in actual film-formation process.

FIGS. 9(*a*)-9(*e*) are explanatory diagrams showing the leveling process. In FIG. 9(*a*), when an ink droplet having a weight M1*a* hits the substrate, the kinetic energy of the ink droplet is converted into free energy such as the interface (or surface) energy thereof, and the ink droplet wets and spreads out to form a contact angle θ (see FIG. 9(*b*)). If the ink droplets having the weights M1*b*, M1*c*, and M1*d* are ejected sequentially before the tackiness phenomenon due to drying starts up (FIGS. 9(*c*), 9(*d*), and 9(*e*)), these ink droplets combine with each other. As a result, the weight variations within a certain fixed range will be absorbed. This range increases as the speed at which the ink droplets hit increases, and also as the contact angle θ grows smaller, and further as evaporation is delayed.

Since the nozzles 200 of this embodiment are disposed at a density of 150 npi (nozzles/inch), the nozzle pitch is 0.17 (=25.4/150) mm and one edge of a block (4×4 dots) is 0.68 (=0.17×4) mm. The precision of the thickness of the film 106 can be increased ultimately, provided the coating is done under conditions corresponding thereto.

The inkjet apparatus 100 adjusts the total weight of ink droplets that have been ejected from the plurality of nozzles. Herewith, the coating is done to a high precision and also rapidly. In addition, the circuit can be simplified since the ejection weight is not adjusted for each nozzle. Furthermore, there is no need to measure the weights again, so the adjustment step can be shortened.

The drive voltage waveform generator 406 generates the single drive voltage waveform Vd, no matter how high the number N of the nozzles 200 are. Accordingly, the drive voltage waveform generator 406 can be configured extremely simply. Even if a time division method that is known in the art is used, the recording speed does not decrease substantially, since the inkjet apparatus 100 according to this embodiment generates only four types of waveforms a to d.

Note that it is possible to form a block by a smaller number of dots, such as (3×3), than the (4×4) described above, when it is difficult to smooth a large number of the ink droplets such as this embodiment (4×4) by a narrow leveling range. Even if a block is formed by (3×3), there are combinations of 512 ($=2^9$) ways. Accordingly, sufficient effects described above can be obtained in such a case.

Next, an inkjet apparatus 100 according to second embodiment of the present invention will be described while referring to FIGS. 10 and 11. It is assumed that the inkjet apparatus 100 according to the second embodiment is be used such a case that any area is coated, while the inkjet apparatus 100 according to the first embodiment is used for such a case that a single-surface solid film is coated.

Figure 10:
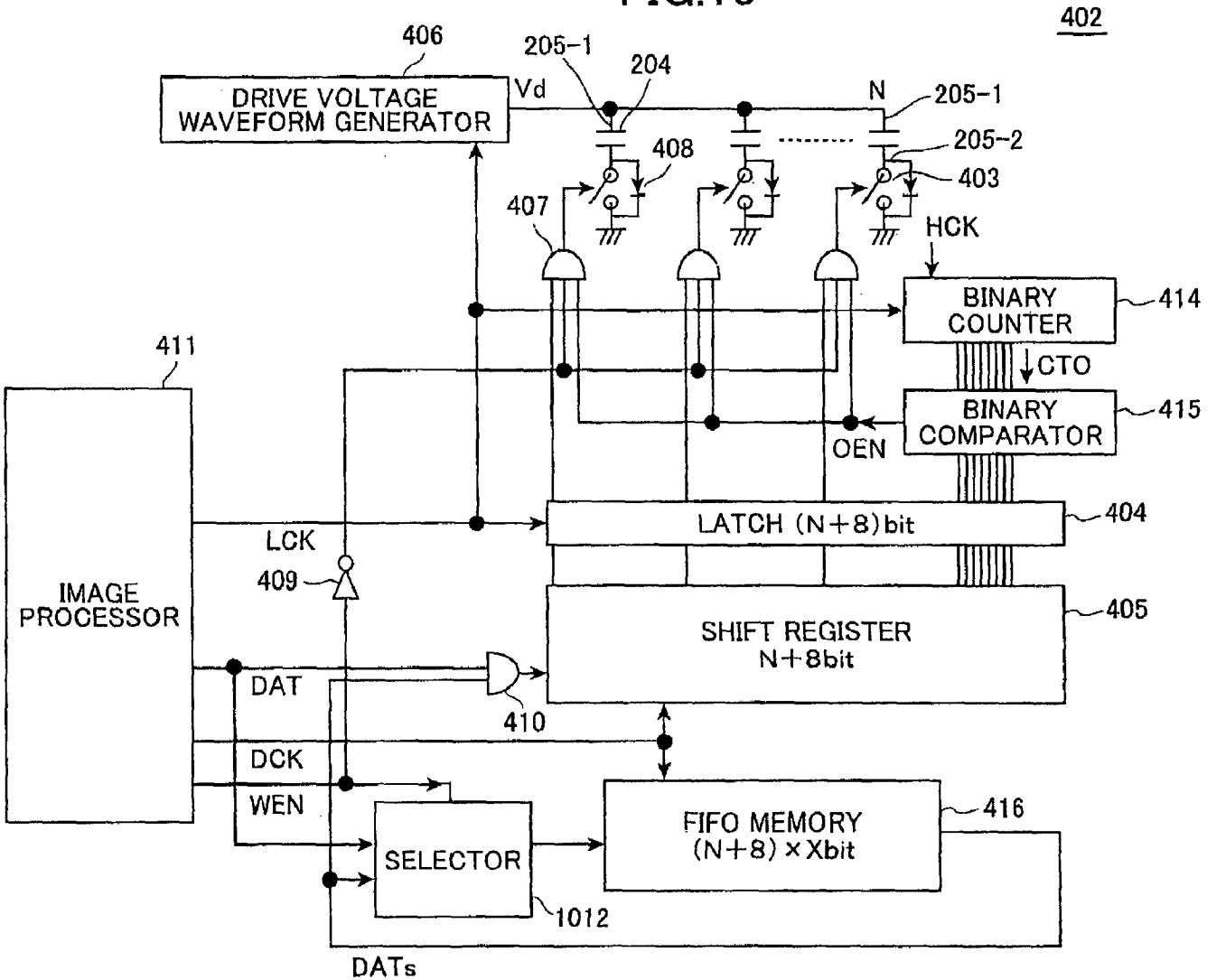
FIG. 10 is a circuit diagram of the digital signal processor 411 and the piezoelectric element driver 402.

FIG. 10 is a circuit diagram of the digital signal processor 411 and the piezoelectric element driver 402 of this embodiment. In this embodiment, the selector 1012 outputs a digital coating signal DAT that is input by the digital signal processor 411 to the FIFO memory 416, but does not output it to the shift register 405. The FIFO memory 416 stores the digital coating signal DAT input from a selector 1012 and outputs the digital coating signal DAT as the reference digital coating signal DATs to the selector 1012 and an AND gate 410. In this embodiment, the FIFO memory 416 has a capacity of (N+8)×X bits.

The AND gate 410 performs AND operation on the reference digital coating signal DATs and the digital coating signal DAT, and outputs either the reference digital coating signal DATs or the digital coating signal DAT to the shift register 405. AND gates 407 connected to the switch 403 have a three-terminal. The comparison signal OEN is input to the first terminal, the count signal CTO is input to the second terminal, and the select signal WEN is input to the third terminal through a NOT gate 409, while the select signal WEN is also input to the selector 1012.

The selector 1012 outputs the digital coating signal DAT to the FIFO memory 416 when the logic of the select signal WEN is "1", while the selector 1012 outputs the cyclic data DATR to the FIFO memory 416 when the logic thereof is "0". Accordingly, even if both the logic of the comparison signal OEN and the ejection signal Dn are "1", when the logic of the select signal WEN is "1" (though inverted by the NOT gate 409), the switch 403 opens.

Figure 11:
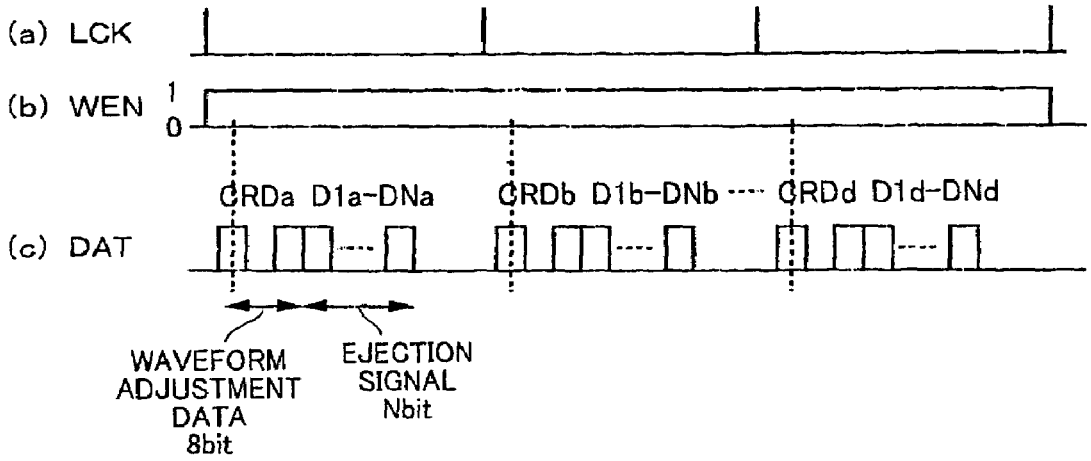
FIGS. 11(*a*)-11(*c*) are timing charts of the transfer of the digital coating signal DAT to the FIFO memory 416.

FIGS. 11(*a*)-11(*c*) are timing charts of the transfer of the digital coating signal DAT to the FIFO memory 416. In this case, X is 4 (the waveforms a to d shown in FIG. 6). Before the adjustment operation, the digital coating signal DAT is stored in the FIFO memory 416 until the capacity of the FIFO memory 416 is completely filled. Since the select signal WEN is "1" at this time, a logic of a signal that is input to the AND gates 407 from the NOT gate 409 is "0", causing the switch 403 open. Thus, when the digital signal processor 411 transfers the digital coating signal DAT to the FIFO memory 416, the AND gates 407 does do not output the digital coating signal DAT from the shift register 405 to the switch 403, causing the switch 403 open.

Figure 12:
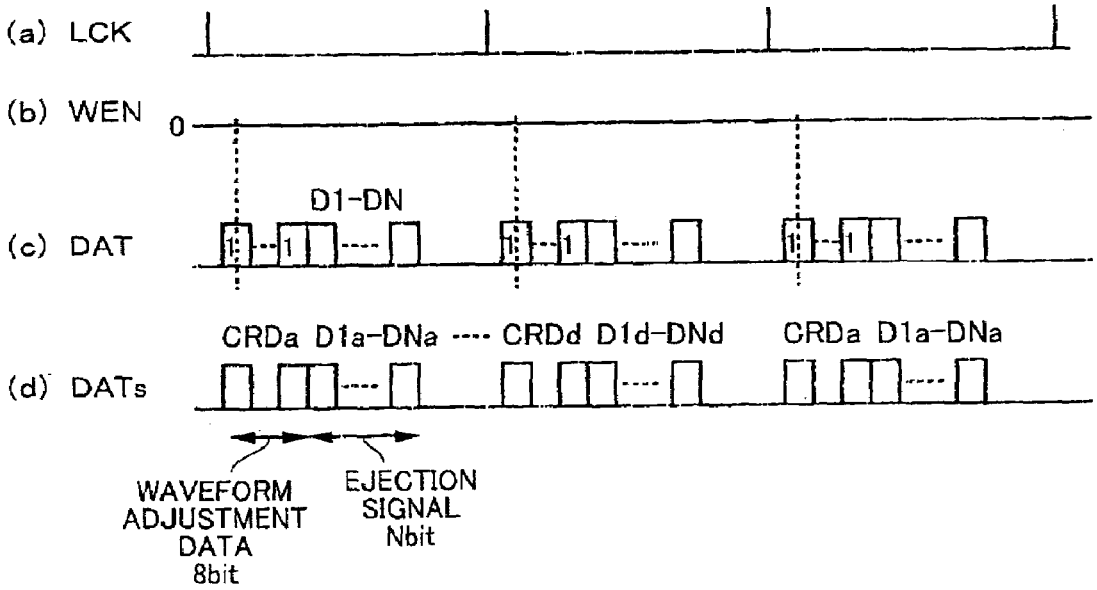
FIGS. 12(*a*)-12(*d*) are timing charts in the adjustment operation.

When the capacity of the FIFO memory 416 is completely filled with the digital coating signal DAT, an adjustment operation is performed. In the adjustment operation, as shown in FIGS. 12(*a*)-12(*d*), the reference digital coating signal DATs is output from the FIFO memory 416 to the AND gate 410 in synchronization with the data clock DCK, and the digital signal processor 411 switches the select signal WEN to "0".

The AND gate 410 performs AND operation on the reference digital coating signal DATs and the digital coating signal DAT, and outputs the result to the shift register 405. In this embodiment, the first 8 bits (in other words, the waveform adjustment data CRD) of the digital coating signal DAT are all "1" ("FF" in hexadecimal). Thus, since the first 8 bits of the reference digital coating signal DATs are output without change to the shift register 405 as the digital coating signal DAT, the waveform adjustment data CRD stored in the FIFO memory 413 is always valid.

On the other hand, the ejection signals Dn of the digital coating signal DAT are arbitrary data that reflects a coating area. Accordingly, the ejection signals Dn input to the shift register 405 do not depend on the ejection signals Dn of the reference digital coating signal DATs. This ensures that only the desired area on the substrate is coated. Since the select signal WEN (see FIG. 12(*b*)) is "0" during the coating operation, the reference digital coating signal DATs that is output from the FIFO memory 416 is input again to the FIFO memory 416 cyclically. Further, since the select signal WEN is "1", the select signal WEN "0" inverted by the NOT gate 409 is input to the third terminal of the switch 403. Accordingly, the opening and closing of the switch 403 is dependent on only the digital coating signal DAT and comparison signal OEN.

In this embodiment, while the digital coating signal DAT is transferred to FIFO memory 416, the shift register 405 does not output the digital coating signal DAT to the switch 403, since the logic "0" is input to the switch 407 through the NOT gate 409. Accordingly, there is no unnecessary coating during transferring the digital coating signal DAT, such a case that a user modifies the digital coating signal DAT which has been stored. Further, since the ejection is controlled by the arbitrary digital coating signal DAT from the digital signal processor 411, the coating can be performed for only desired area.

While the invention has been described in detail with reference to the specific embodiment thereof, it would be apparent to those skilled in the art that various changes and modifications may be made therein without departing from the spirit of the invention.

For example, the voltage applied to the piezoelectric element 204 may be divided into more than 256 steps by increasing the waveform adjustment data CRD more than 8 bits, while in those embodiments the voltage is divided into 256 steps using the waveform adjustment data CRD of 8 bits. Thus, the voltage applied to the voltage element 204 can be adjusted more finely, causing more fine coating image.

In the second embodiment, the digital signal processor 411 transfers the digital coating signal DAT to both the shift register 405 and FIFO memory 416 from a single terminal. However, the digital signal processor 411 may be provided with two output terminals to transfer different digital coating signals to the shift register 405 and FIFO memory 416 respectively. This will enable modification of the reference digital coating signal DATs within the FIFO memory 416 even during the coating operation.

In these embodiments, the drive voltage generator generates a single drive voltage having a predetermined waveform. However, the drive voltage generator may generate a number of drive voltages having different waveforms, where the number of drive voltages generated by the drive voltage generator is less than a number of nozzles.

What is claimed is:

1. An inkjet apparatus comprising:

a plurality of nozzles that eject ink droplets;

a plurality of piezoelectric elements provided in one-to-one correspondence with the plurality of nozzles, each of the plurality of piezoelectric elements applying pressure to a corresponding nozzle to eject ink droplets therefrom in response to an applied drive voltage;

a drive voltage generator that generates a drive voltage having a waveform;

a data processor into which is inputted both waveform adjustment data indicating a desired waveform to be applied to a piezoelectric element and ejection signals indicating whether or not each nozzle ejects an ink droplet, the data processor transferring the waveform adjustment data and the ejection signals, each of the plurality of piezoelectric elements being controlled whether or not to apply pressure to a corresponding nozzle based on the ejection signals transferred from the data processor; and an adjustment unit that adjusts the waveform of the drive voltage for each piezoelectric element based on the waveform adjustment data transferred from the data processor and transfers the adjusted waveform to each of the plurality of piezoelectric elements, wherein a group of ink droplets is ejected from a prescribed number of nozzles during a prescribed time period based on both the adjusted waveform and the ejection signal, and the ink droplets in the group blend with each other to attain a leveling effect, and wherein a weight of the group of ink droplets changes depending on assortments of the adjusted waveforms and the ejection signals, the waveform adjustment data and the ejection signals being inputted into the data processor such that the weight of the ink droplets in the group is the closest to a target weight.

2. The inkjet apparatus according to claim 1, wherein the plurality of piezoelectric elements is actuated substantially simultaneously.

3. The inkjet apparatus according to claim 1, wherein the drive voltage generator generates a number of drive voltages having different waveforms, the number of drive voltages generated by the drive voltage generator being less than a number of nozzles.

4. The inkjet apparatus according to claim 1, wherein the drive voltage generator generates a single drive voltage having a predetermined waveform.

5. The inkjet apparatus according to claim 1, wherein both the waveform adjustment data and the ejection signal are digital signals.

6. The inkjet apparatus according to claim 1, wherein the plurality of nozzles are aligned at an equi-pitch, and the prescribed number of nozzles is aligned one after another.

7. The inkjet apparatus according to claim 1, further comprising a memory that stores combined data that is a combination of the waveform adjustment data and the ejection signal both transferred from the data processor, and transfers the combined data stored in the memory to the adjustment unit repeatedly.

8. The inkjet apparatus according to claim 7, further comprising a selector that selectively transfers one of the combined data stored in the memory and the combined data transferred directly from the data processor to the adjustment unit based on a select signal input to the selector from the data processor.

9. The inkjet apparatus according to claim 1, further comprising:

a memory that stores combined data that is a combination of the waveform adjustment data and the ejection signal both transferred from the data processor, and transfers the combined data stored in the memory to the adjustment unit repeatedly; and a gate connected to the adjustment unit, the gate prohibiting the combined data stored in the memory from passing to the adjustment unit based on an instruction from the data processor.

10. The inkjet apparatus according to claim 9, further comprising a selector that selectively transfers one of the combined data stored in the memory and the combined data transferred directly from the data processor to the memory based on a select signal input to the selector from the data processor.

11. The inkiest apparatus according to claim 1, further comprising:

an XYZ stage transporting a substrate proximate to said plurality of nozzles; and an XYZ controller controlling a movement of the XYZ stage in response the data processor, wherein the drive voltage applied to each of the plurality of piezoelectric elements is controlled based on the waveform adjustment data and the ejection signal so that a total weight of ink droplets ejected from a prescribed number of nozzles during a period of time when a predetermined number of ejection signals are generated is closest to a target weight and all the ink droplets blend with each other to attain a leveling effect and form a uniform film on the substrate.

* * * * *